US006267495B1

(12) United States Patent
Hurst

(10) Patent No.: US 6,267,495 B1
(45) Date of Patent: Jul. 31, 2001

(54) BLENDER APPARATUS WITH PRECISION LOW-RATE METERING UNIT

(75) Inventor: Terre G. Hurst, Duluth, GA (US)

(73) Assignee: Process Control Corporation, Atlanta, GA (US)

( * ) Notice: Subject to any disclaimer, the term of this patent is extended or adjusted under 35 U.S.C. 154(b) by 1111 days.

(21) Appl. No.: 08/615,790

(22) Filed: Mar. 14, 1996

Related U.S. Application Data

(63) Continuation of application No. 08/329,150, filed on Oct. 25, 1994, now abandoned.

(51) Int. Cl.[7] ..... B01F 15/02

(52) U.S. Cl. ..... 366/76.91; 366/156.2

(58) Field of Search ..... 366/16, 20, 35, 366/38, 133, 156, 177, 186, 156.2; 222/145.5, 145.6, 145.7, 412, 413

(56) References Cited

U.S. PATENT DOCUMENTS

| | | | | |
|---|---|---|---|---|
| 1,611,297 | * | 12/1926 | Wickey | 366/35 |
| 1,757,341 | | 5/1930 | Smit . | |
| 2,604,659 | | 7/1952 | Eppler | 18/12 |
| 2,834,720 | * | 5/1958 | Savoca | 222/413 |
| 2,957,608 | | 10/1960 | Wahl | 322/161 |
| 2,970,532 | * | 2/1961 | Skelton | 366/177.1 |
| 3,645,505 | * | 2/1972 | McLeod, Jr. | 222/413 |
| 3,684,082 | | 8/1972 | Wardell | 198/213 |
| 3,799,404 | * | 3/1974 | Taupin | 222/413 |
| 4,016,970 | | 4/1977 | Wert | 198/524 |
| 4,256,217 | | 3/1981 | Mathias | 198/536 |
| 4,443,109 | * | 4/1984 | Watts | 366/156 |
| 4,518,262 | * | 5/1985 | Bornemann | 366/156 |
| 4,759,633 | * | 7/1988 | Schmid | 222/413 |
| 4,987,850 | * | 1/1991 | McCracken | 366/177.1 |
| 5,261,743 | * | 11/1993 | Moller | 366/20 |
| 5,352,035 | * | 10/1994 | Macaulay | 366/186 |
| 5,471,917 | * | 12/1995 | Hsu | 366/303 |

FOREIGN PATENT DOCUMENTS

| | | | | |
|---|---|---|---|---|
| 515171 | * | 12/1930 | (DE) | 366/20 |
| 3504397 | * | 8/1986 | (DE) | 366/20 |
| 732590 | * | 9/1932 | (FR) | 366/186 |
| 756745 | * | 12/1933 | (FR) | 366/156 |
| 118491 | * | 12/1888 | (GB) | 366/38 |
| 218026 | * | 7/1924 | (GB) | 366/20 |
| 0085190 | * | 3/1990 | (JP) | 222/412 |

* cited by examiner

*Primary Examiner*—Randall E. Chin
(74) *Attorney, Agent, or Firm*—Todd Deveau; Ryan A. Schneider; Troutman Sanders LLP

(57) ABSTRACT

A blender apparatus with a plurality of metering units, including at least one precision metering unit for precision metering of solid particulate materials at low flow rates, the apparatus including a common hopper for receiving metered individual ingredients from the plurality of individual ingredient metering units, the precision metering unit including an elongate tubular hopper for stabilizing the head pressure of material presented to the metering unit's auger.

17 Claims, 4 Drawing Sheets

BLENDER APPARATUS WITH PRECISION LOW-RATE METERING UNIT

This is a continuation of application(s) Ser. No. 08/329,150 filed on Oct. 25, 1994 now abandoned and which designated the U.S.

TECHNICAL FIELD

The present invention generally relates to a device for blending solid particulate matter, and more particularly relates to an improved blender apparatus for high-precision metering of at least one particulate ingredient at low flow rates.

BACKGROUND OF THE INVENTION

Blending devices for blending various types of solid particulate ingredients, such as plastic pellets, are well-known in the art. Generally, these devices include a number of ingredient hoppers, each of which discharge ingredients into individual metering units. These metering units typically include a metering auger, the rotational speed of which can be varied to control the flow rate of the individual ingredients. The metering units discharge individual ingredients into some sort of common hopper at independently controllable feed rates which can be varied to produce the desired blend of individual ingredients. Typical feed devices are shown, for example, by U.S. Pat. No. 1,757,341 to Smit, U.S. Pat. No. 2,957,608 to Wahl, and U.S. Pat. No. 3,684,082 to Wardell.

Advances in material and compounding technologies have led to the production of ingredients for blending with a higher concentration of additive materials, such as pigments and antioxidants. These highly concentrated ingredients are usually more costly than the other materials in the blend and typically constitute a very low percentage of the total blend, which requires operation of at least one of the metering units at very low flow rates, often at 0.2 lbs./hr or less. When operating a metering unit at such low rates, it is desirable to achieve as small a short-term flow rate variation as possible. Ideally, it would be preferable to eliminate such short-term flow rate variations. In many situations it is necessary or important to maintain at least a minimum flow rate, despite the undesirable short-term fluctuations in flow rate. In such situations, it has been common to set the nominal or target rate well above the required minimum flow rate in order to ensure that the minimum rate is maintained despite short-term fluctuations in flow rate. Substantial cost savings could be achieved if the nominal or target rate could be set closer to the minimum rate while still ensuring that the minimum flow rate is maintained.

It has been discovered by Applicant that one of the primary causes of flow rate fluctuations at low flow rates is the rotation of the metering auger itself. Existing prior art metering devices typically are fed by circular, square or rectangular ingredient hoppers with the lower portion having converging walls mounted directly to the metering auger housing, as demonstrated by U.S. Pat. No. 1,757,341 to Smit. In this arrangement, the weight of ingredient particles in the hopper is supported almost entirely by the sloped walls of the ingredient hopper, with only a small fraction of the weight of the ingredients being reactive with (i.e. affected by) the auger. It has been found that upward forces resulting from the rotation of the auger cause perturbations in this small reactive volume of particulate matter just above the auger. At low metering rates these perturbations are sufficient to cause fluctuations in material feed to the auger, thus resulting in uneven operation.

Accordingly, it can be seen that a need yet remains for a blender apparatus capable of precise low-rate metering, which minimizes perturbations in the low-rate metering. It is to the provision of such a blending apparatus capable of providing such precision low-rate metering that the present invention is primarily directed.

SUMMARY OF THE INVENTION

Briefly described, in a preferred form the present invention comprises a blender apparatus including a number of individual ingredient metering units, at least one of which is capable of precision low-rate metering. Preferably, the individual metering units feed ingredients to a common hopper which can be used to store blended material for subsequent use, or serve as a reservoir of blend for feeding a processing machine.

The precision low-rate metering unit includes a vertical elongate tubular hopper over the throat of a metering auger housing, with the tubular hopper being substantially longer than a transverse dimension of the throat. This tubular hopper discharges ingredients by gravity feed to the metering auger. Because the tubular hopper does not have sloped walls, as do existing circular, square or rectangular hoppers, very little of the weight of the ingredient is supported by the hopper. Rather, nearly all of the weight of the ingredient acts to force the ingredient downward, into the auger housing. The tubular hopper thus acts to increase the quantity of material which is reactive with (influenced by) the auger, thereby Minimizing the effect of upward perturbations caused by the auger's rotation. This effectively increases the weight of the column (head) of material positioned over the auger and, as a result, upward forces on the column caused by the rotation of the auger are thus rendered smaller in relation to the weight of the column. By stabilizing the head pressure of material presented to the auger in this manner, the accuracy of the auger's metering is substantially improved.

Thus, it is an object of the present invention to provide a blender apparatus capable of precision metering of particulate materials at low flow rates.

It is another object of the present invention to provide a blender apparatus which achieves accurate and consistent blending despite perturbations caused by rotation of the metering auger.

It is a further object of the present invention to provide a blender apparatus which is durable in use, economical in manufacture and reliable in operation.

It is another object of the present invention to provide a blender apparatus that reduces production cost of products which utilize highly concentrated ingredients which are metered at low rates.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION

Figure 1:
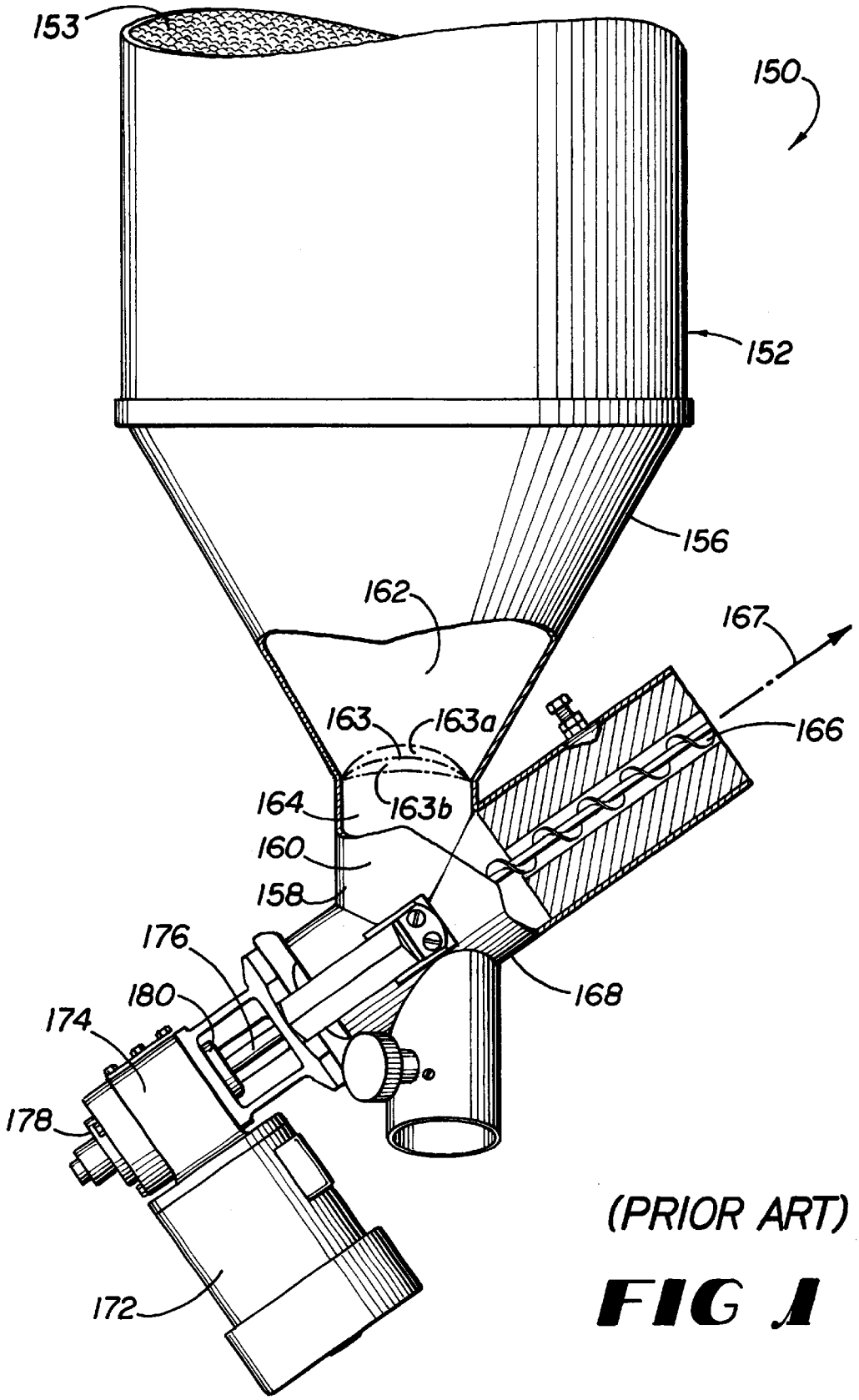
(PRIOR ART) FIG 1
FIG. 1 is an elevational view of a typical prior art metering unit shown in partial cross-section.

Referring now in detail to the drawing figures, wherein like reference numerals represent like parts throughout the several views, FIG. 1 shows a typical prior art metering unit 150 which includes a conical hopper 152 having sloped walls 156 which conduct ingredients 153 through a throat 160 into an auger housing 168. A hopper discharge section or connection 158 connects the conical hopper 152 with the auger throat 160. Ingredients 153 are conveyed along direction 167 through the auger housing 168 by an auger 166, as the auger 166 rotates. The flow rate of ingredients 153 through the metering unit 150 can be adjusted by varying the rotational speed at which the auger 166 is driven. Auger 166 is driven by a motor 172, the output of which is coupled with a shaft 176 through a gear box 174. Shaft 176 rotates within outer and inner bearings 178, 180 to drive the auger 166. Such a prior art metering unit has been made and sold by Process Control Corporation of Atlanta, Georgia in conjunction with several different model blenders.

Applicant has discovered that the sloped walls 156 of the conical hopper 152, typical of prior art metering unit 150, bear nearly the entire weight of ingredients 153 contained in the conical hopper 152. Generally, only a small portion of the weight of ingredients 153 interacts with (i.e. is influenced by) auger 166. This small portion of ingredients constitutes a reactive volume 164 beneath the boundary area 163. The weight of ingredients in a non-reactive volume 162, above the boundary area 163, is borne substantially entirely by the sloped walls 156 of the conical hopper 152. The weight of ingredients in the reactive volume 164 presses downwardly through the throat 160 onto auger 166, thus creating an effective head pressure in communication with auger 166. As auger 166 rotates, it imposes periodic or irregular upward forces on ingredients in the hopper discharge section 158. These forces cause perturbations in the reactive volume 164 causing boundary area 163 to fluctuate (rise and fall). The fluctuation of boundary area 163 is illustrated by positions 163*a* and 163*b*. The reactive volume 164, defined as the volume underneath the boundary area 163, thus is largest when boundary area 163 is in position 163*a*, and is smallest when boundary area 163 is in position 163*b*. Although small in absolute magnitude, the resulting fluctuations in head pressure experienced by auger 166 are significant in proportion to the weight of ingredients in the small reactive volume 164 of typical prior art devices. The resulting fluctuations in feed rate, while small (in absolute magnitude), become increasingly troublesome as feed rates are reduced.

Figure 2:
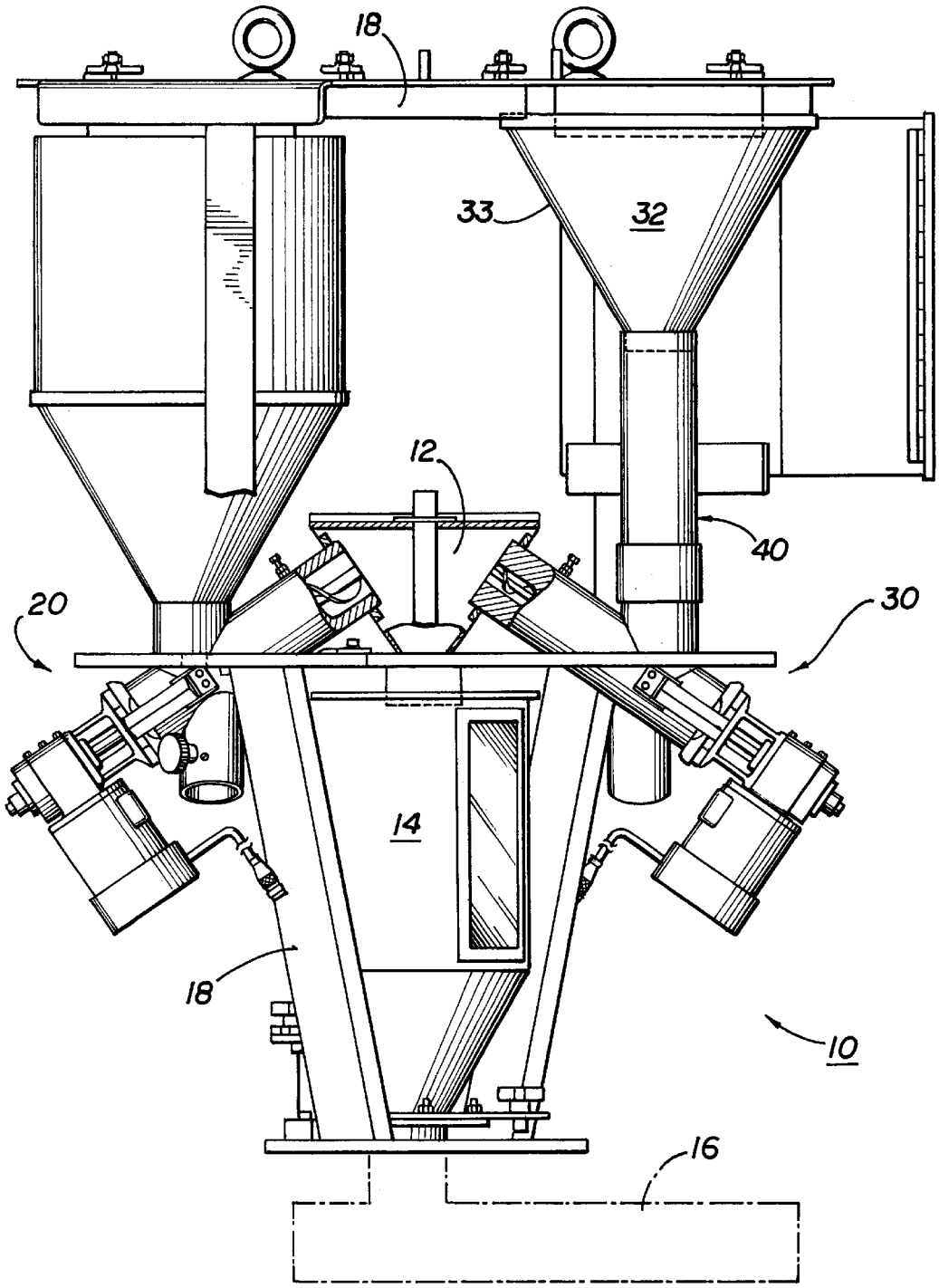
FIG. 2 is a front elevational view of a blender apparatus according to a preferred form of the present invention and including a precision low-rate metering unit.

The blender apparatus of the present invention minimizes fluctuations in flow rate caused by these variations in head through the use of an innovative precision low-rate metering unit. FIG. 2 depicts the general arrangement of a blender apparatus according to one form of the invention for metering of solid particulate matter. Blender apparatus 10 frequently forms part of a continuous plastics processing line, such as an extrusion line, but it will be apparent to those skilled in the art that the present invention can be applied to a variety of processing operations. The blender apparatus 10 can be fabricated on a frame 18 of conventional construction such that the entire apparatus may be transported, as by a crane or overhead lifting device. Alternatively, the apparatus 10 can be constructed and installed with its elements individually supported.

The apparatus includes a plurality of metering units, some of which may be of the design of typical prior art metering units, such as metering unit 150 shown in FIG. 1. The blender apparatus 10 illustrated in FIG. 2 includes a conventional metering unit indicated at 20 and at least one precision low rate metering unit 30. Of course, those skilled in the art will understand that while a two unit apparatus is depicted, more units can be provided. All of the metering units preferably discharge through a cascade chamber 12 which discharges the blended ingredients into a common hopper 14. Blended ingredients from common hopper 14 can be stored, transported, or further processed as by processing machine 16 (shown in phantom lines in FIG. 2).

Figure 3:
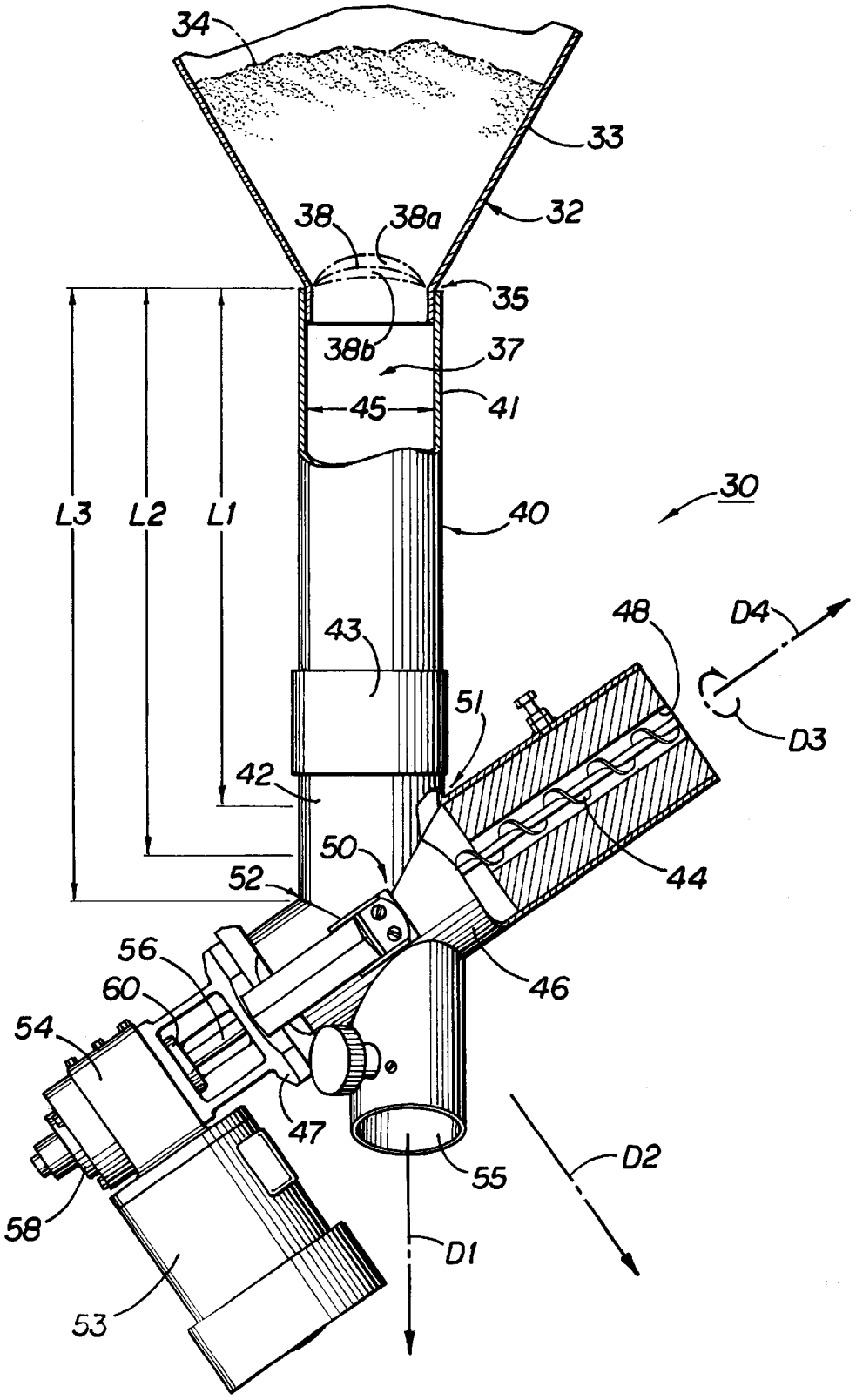
FIG. 3 is a back elevational view of the low-rate metering unit of FIG. 2 shown in partial cross-section.
Figure 4:
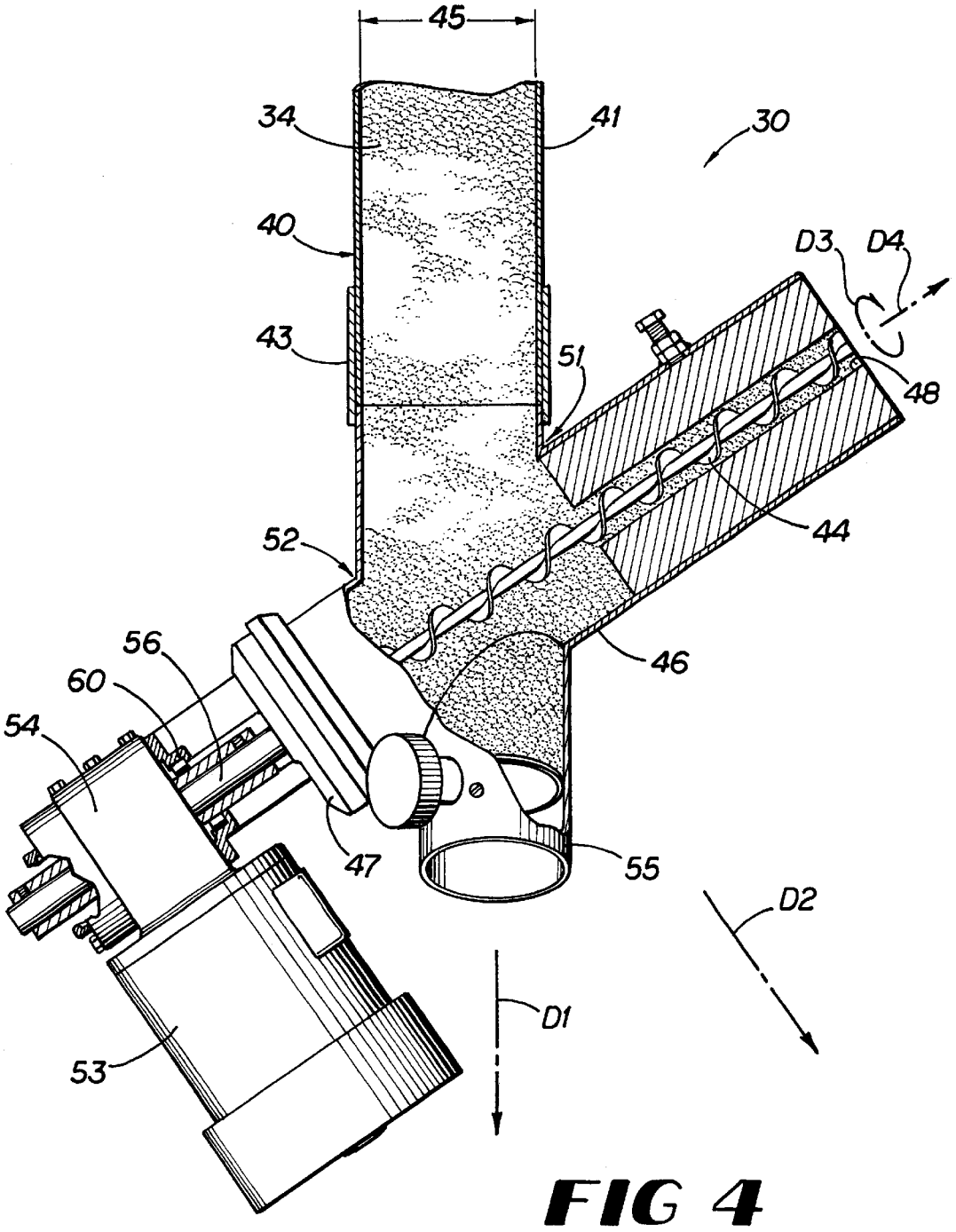
FIG. 4 is a partially cutaway view of the low-rate metering unit of FIG. 3 in greater detail.

The precision low rate metering unit 30 shown in preferred form in FIGS. 2-4 includes a circular, square or rectangular feed hopper 32 having inwardly sloping lower walls 33 for containing ingredients 34. Feed hopper 32 can be fabricated from sheet metal and preferably is shaped as a cone or an inverted pyramid.

An opening in a lower end 35 of feed hopper 32 discharges ingredients 34 into an elongate tubular hopper 40. Tubular hopper 40 preferably is circular in cross-section, however, it will be clear to those skilled in the art that tubular hoppers of square, rectangular, oval, or other cross-sections may be utilized. Tubular hopper 40 preferably is fabricated largely from a material having a low coefficient of friction with ingredients 34. It is preferable that at least part of the tubular hopper be transparent, so that the level and flow within tubular hopper 40 may be visually observed. Acrylic tubing has been found to be an acceptable material of fabrication, however, it will be clear to those skilled in the art that a variety of materials may be utilized, depending on the properties of ingredients 34. Alternatively, tubular hopper 40 may be fabricated from standard sheet metal and may be provided with a low-friction liner or coating.

In order to provide effective operation, as will be more fully described below, tubular hopper 40 is substantially longer than it is wide and preferably has a length of at least two times its diameter (or transverse dimension) 45. It is preferable, however, that greater length-to-diameter ratios be provided, with very good performance being achieved by an acrylic tubular hopper having a length-to-diameter ratio of seven-to-one or five-to-one, although ratios of three-to-one and four-to-one work well also.

The tubular hopper 40 includes an upper tubular section 41, a lower section 42, and a connector or transition coupling 43. Lower section 42 is substantially cylindrical and welded or otherwise secured to an auger housing 46. At the transition between the lower section 42 and the auger housing 46, a throat indicated generally at 50 is defined. Viewed from above (in the direction of direction arrow D1), throat 50 appears as a circular opening. Viewed from a position normal to the auger housing 46 (in the direction of direction arrow D2), throat 50 appears as an oval or elliptical opening. An upper edge of the throat lies adjacent an upper edge 51, while a lower edge of the throat lies adjacent a lower edge 52. Of course, rather than being made in sections, the tubular hopper 40 could be of unitary construction.

In comparing the length of the tubular hopper 40 with its inside diameter 45, different values are obtained depending upon whether one measures length from the upper edge of the throat (see L1), from the lower edge of the throat (see L3), or from halfway in between (see L2). Of course, if one were to orient the auger housing 46 horizontally, and thus perpendicular to the vertical tubular hopper 40, there would be only one length to be concerned with. To establish a convention for measuring the length of the tubular hopper in relation to an upwardly-inclined auger housing, it will be understood to be measured to the center of the throat as depicted by L2 in FIG. 3.

Tubular hopper 40 discharges ingredients by gravity flow into the throat 50 of to auger housing 46. The connector or transition coupling 43 can be utilized to connect the upper section 41 of tubular hopper 40 to lower section 42. Alternatively, welding or other standard attachment means may be utilized.

Auger housing 46 preferably is a hollow cylindrical tube fabricated from steel or other suitable material and preferably is oriented in an inclined position relative to horizontal, however, horizontal orientation also could be used. Auger housing 46 includes an auger discharge bore 48, which preferably is a circular opening centrally located on the upper end of auger housing 46. Ingredients metered by the precision low-rate metering unit 30 are discharged from the auger discharge bore 48 into the cascade chamber 12 of the blender apparatus 10, as shown in FIG. 2. The lower end of auger housing 46 preferably is capped, as by housing end cap 47, through which a driven shaft 56 extends. An unshown mechanical seal can be provided between housing end cap 47 and driven shaft 56 to prevent ingredients 34 from escaping auger housing 46 through the shaft opening in housing end cap 47. Auger housing 46 can also include a clean-out tube 55 extending obliquely from auger housing 46 in a generally downward direction.

An auger 44, located axially within auger housing 46, extends from housing end cap 47 at the lower end of auger housing 46 to auger discharge bore 48 at the housing's upper end. Auger 44 preferably is of the type having a shaft with helical vanes. Auger 44 can be rigidly coupled at its lower end to driven shaft 56 which extends through an opening centrally located in housing end cap 47. Driven shaft 56 is rotationally driven by motor 53 through a gear box 54. Outer and inner bearings 58, 60 on gearbox 54 support shaft 56 and allow it to rotate smoothly.

In operation, the blender apparatus 10 of the present invention, as shown in the attached figures, provides precision metering of particulate materials at low flow rates, and overcomes the above-described undesirable problem of flow rate fluctuations of prior art devices. As motor 53 rotates shaft 56 and auger 44 in the direction of direction arrow D3, auger 44 contacts ingredients 34 in auger housing 46,. and conveys ingredients 34 upwardly, towards and through auger discharge bore 48 in the direction of direction arrow D4. As auger 44 rotates, upward forces resulting from the rotation cause small perturbations in the weight of the particulate matter above the auger. As described above, these perturbations are sufficient to cause unacceptable flow rate fluctuations in prior art metering devices when operating at low flow rates. The precision low-rate metering device of the present invention, however, significantly reduces these flow rate fluctuations by the provision of the tubular hopper 40, which creates a reactive volume 37 beneath boundary 38 of greatly increased volume as compared to known prior art metering devices. This increased size of reactive volume 37 greatly increases the overall head pressure upon auger 44. Although perturbations in the reactive volume 37 cause boundary 38 to fluctuate through positions 38, 38*a*, and 38*b*, the change in volume occasioned by these perturbations constitutes a relatively insignificant fraction of the overall reactive volume 37. Because of the greatly increased reactive volume 37, and corresponding increase in effective head pressure communicating with auger 44, the effect of boundary fluctuations 38*a*, 38*b* on the feed rate is greatly reduced. As shown in FIGS. 3 and 4, the tubular hopper 40 extends substantially vertically upward from the auger housing 46. Because the walls of the hopper 40 are substantially vertical, and because the opening at the lower section 42 of the tubular hopper 40 is coterminous with the periphery of the auger housing throat 50, unmetered ingredient 34 discharges unobstructedly and substantially vertically downward from the hopper 40 into the auger housing 46.

Preliminary tests indicate that substitution of a low-rate metering unit as disclosed herein in place of a prior art metering unit reduces the short term fluctuation by approximately 40% when metering at 1 lb/hr or at 0.2 lb/hr. This reduction in metering rate fluctuation enables the production of acceptable product while using much less of the expensive concentrated ingredients than with prior art metering units.

The blender apparatus of the present invention is capable of precise metering at low individual flow rates, and provides accurate and consistent metering despite perturbations caused by rotation of the metering auger. The design is elegantly simple, resulting in an apparatus which is durable in use, economical in manufacture, and reliable in operation.

While the invention has been disclosed in a preferred form, it will be apparent to those skilled in the art that many modifications, additions, and deletions can be made therein without departing from the spirit and scope of the invention and its equivalents as set forth in the following claims.

What is claimed is:

1. A blender apparatus comprising:

a plurality of individual ingredient metering units for metering individual ingredients, at least one of said individual ingredient metering units being provided for low-rate metering and comprising a driven metering auger and an auger housing for housing said auger, said auger housing having a throat for receiving an unmetered ingredient and presenting the unmetered ingredient to said auger, said throat having a transverse dimension, said at least one individual ingredient metering unit further comprising an elongate tubular hopper and an upper hopper, said tubular hopper having a first end connected to said throat and extending substantially vertically upward to a second end adjacent said upper hopper and providing an unobstructed substantially vertical flow of unmetered ingredient to said auger housing, whereby substantially the entire weight of said unmetered ingredient within said tubular hopper bears upon said auger, said elongate tubular hopper being substantially longer than said transverse dimension of said throat.

2. The blender apparatus of claim 1 wherein the length of said elongate tubular hopper is at least twice said transverse dimension of said throat.

3. The blender apparatus of claim 1 wherein the length of said elongate tubular hopper is at least four times said transverse dimension of said throat.

4. The blender apparatus of claim 1 wherein the length of said elongate tubular hopper is at least five times said transverse dimension of said throat.

5. The blender apparatus of claim 1 wherein said elongate tubular hopper is fabricated from acrylic tubing.

6. The blender apparatus of claim 1 wherein said elongate tubular hopper has a circular cross-section and a length-to-diameter ratio of at least two.

7. The blender apparatus of claim 6 wherein said elongate tubular hopper has a length-to-diameter ratio of at least four.

8. The blender apparatus of claim 1 wherein said metering auger and said auger housing are inclined upwardly from horizontal.

9. The blender apparatus of claim 1 wherein the length of said elongate tubular hopper is at least three times said transverse dimension of said throat.

10. The blender apparatus of claim 1 wherein the length of said elongate tubular hopper is at least seven times said transverse dimension of said throat.

11. A blender apparatus comprising:

a plurality of individual ingredient metering units for metering individual ingredients, at least one of said individual ingredient metering units being provided for precision low-rate metering and comprising a driven metering auger and an auger housing for housing said auger, an ingredient hopper, and an elongate tubular hopper unobstructedly discharging an unmetered ingredient substantially vertically downward into said auger housing, whereby substantially the entire weight of said unmetered ingredient within said tubular hopper bears upon said auger, said tubular hopper having a first end connected to said auger housing and a second end adjacent said ingredient hopper, with said elongate tubular hopper being substantially longer than it is wide.

12. The blender apparatus of claim 11 wherein said elongate tubular hopper is at least twice as long as it is wide.

13. The blender apparatus of claim 11 wherein said elongate tubular hopper is at least three times as long as it is wide.

14. The blender apparatus of claim 11 wherein said elongate tubular hopper is at least five times as long as it is wide.

15. The blender apparatus of claim 11 wherein said elongate tubular hopper is approximately four times as long as it is wide.

16. The blender apparatus of claim 11 wherein said elongate tubular hopper is fabricated from acrylic tubing.

17. The blender apparatus of claim 11 wherein said elongate tubular hopper is at least seven times as long as it is wide.

* * * * *